US006503601B1

(12) United States Patent
Edvardsen

(10) Patent No.: US 6,503,601 B1
(45) Date of Patent: Jan. 7, 2003

(54) DEFORMABLE ROOF FLASHING MATERIAL AND A METHOD FOR THE MANUFACTURE OF A FLASHING RAIL WITH A SKIRT MADE FROM THE ROOF FLASHING MATERIAL

(75) Inventor: Allan Edvardsen, Skanderborg (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/486,829

(22) PCT Filed: Sep. 4, 1998

(86) PCT No.: PCT/DK98/00376

§ 371 (c)(1),
(2), (4) Date: May 30, 2000

(87) PCT Pub. No.: WO99/13180

PCT Pub. Date: Mar. 18, 1999

(30) Foreign Application Priority Data

Sep. 5, 1997 (DK) ..... 1013/97

(51) Int. Cl.[7] ..... B32B 3/00

(52) U.S. Cl. ..... 428/174; 428/182; 428/457; 428/465; 428/141; 428/121

(58) Field of Search ..... 428/174, 182, 428/457, 465, 141, 121

(56) References Cited

U.S. PATENT DOCUMENTS 1,094,893 A 4/1914 Grant

FOREIGN PATENT DOCUMENTS

| | | |
|---|---|---|
| DE | 87 01 605.2 | 6/1987 |
| DK | WO 95/28536 | 10/1995 |
| EP | 0 038 222 | 10/1981 |
| EP | 0 123 141 | 10/1984 |

*Primary Examiner*—Elizabeth M. Cole
*Assistant Examiner*—Hai Vo
(74) *Attorney, Agent, or Firm*—John P. Shannon; Chad C. Anderson; Venable

(57) ABSTRACT

A deformable roof flashing material for use in connection with skylight windows and roof penetrating structures is provided. The roof flashing material includes a sandwich construction with two outer layers of metal foil and at least one intermediate layer positioned between the outer layers. The material has, in at least one direction, a continuous wave form. At least the intermediate layers adjacent to the outside layers are made from a non-adhesive resilient material. The wave form is formed in such a manner that it maintains the mutual positioning between the outer layers and the adjacent intermediate layers by friction.

16 Claims, 2 Drawing Sheets

Figure 1:
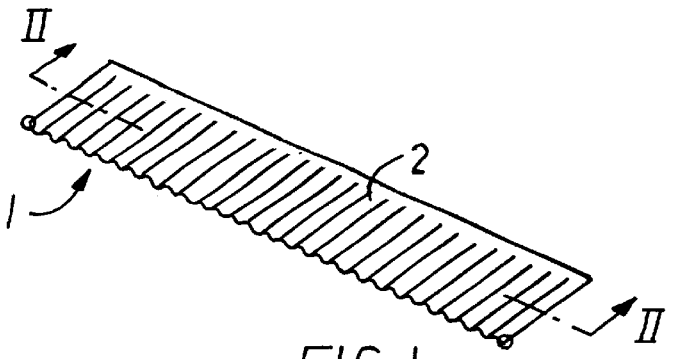

DEFORMABLE ROOF FLASHING MATERIAL AND A METHOD FOR THE MANUFACTURE OF A FLASHING RAIL WITH A SKIRT MADE FROM THE ROOF FLASHING MATERIAL

The invention relates to a deformable roof flashing material for use in connection with skylight windows and the like roof penetrating structures, said roof flashing material comprising a sandwich construction with two outer layers of metal foil and at least one intermediate non-adhesive layer positioned between the outer layers, in which the material at least in one direction has been given a continuous waveform.

Such deformable flashing materials are used for providing a water and snow tight connection between the roof penetrating building structure which may be a chimney, an air shaft, a skylight window or the like, and the surrounding roofing.

Particularly in connection with corrugated roofing, such as for instance tiles, whereby, during mounting, a considerable deformation of the flashing material is required, the use of flashing materials with built-in excess of material in the form of corrugations or foldings has been proposed as a replacement for the previously used sheet lead, which admittedly has a good deformability but the use of which on the other hand is connected with problems seen from an economic and environmental point of view.

Thus, the EP Patent No. 38 222 and the international published specification no. WO95/28536 disclose sandwich materials or composite materials, in which the surplus material has been provided by corrugation in waveform in one or two directions of the flashing material.

In the first-mentioned publication, the individual layers of the structure are kept together by means of an adhesive bitumen layer as the intermediate layer. Apart from the drawback, seen from an environmental point of view, that the individual components of the flashing material cannot be separated at the dismounting, the adhesive connection will have a negative influence on the deformability of the material, and it will in particular be difficult to obtain the lasting deformation necessary for obtaining the desired water and snow tightness.

In the latter publication the mutual securing between the layers forming part of the sandwich structure is established by a second corrugation in a direction substantially perpendicular to the first one. Even though this material has excellent properties in respect of deformability, the manufacturing process is on account of the second corrugation necessarily more costly, and simultaneously the number of intermediate layers and/or the thickness thereof is limited.

From German Utility Model publication no. G 87 01 605.2 a further flashing material is known which comprises a lead layer coated with aluminium foil which in view of mutually securing the layers is pleated and possibly provided with an edge folding. However, the pleating entails that the adaptation to the subjacent roofing is made difficult on account of the sharp foldings of the pleating, which foldings moreover serve as breaking direction for cracks and tear, which on the other hand entails the risk of rain penetrating to the subjacent roof construction.

On this background it is the object of the invention to provide a deformable roof flashing material of the type mentioned by way of introduction and comprising in undeformed condition a sandwich construction in which the layers are not displaced relative to one another and which is moreover easy to handle during the mounting without the risk that the layers of the sandwich constructions are displaced substantially relative to one another, which construction on the other hand, however, allows a certain relative movement of the layers and which is moreover easy and cheap in manufacture and at the same time meets the requirements to a sufficient surplus of material.

This object is met by a roof flashing material, which is characterized in that at least the intermediate layer/s adjacent to the outer layers is/are made from a resilient material, and in that said waveform is formed in such a manner that it maintains the mutual positioning between the outer layers and the adjacent intermediate layer/s by friction.

The special embodiment of waveform in combination with the resilient intermediate layer/layers causes an effective securing between the outer layers and the adjacent layers without the use of adhesive agents, which might prevent deformation of the material during adaptation to the surrounding roofing, and at the same time the single waveform establishes the desired surplus of material, the simplified manufacture and the freedom of choice in respect of the number of layers and/or the thickness thereof. Furthermore, the material has the advantage that it will be self-closing in case of cracks or ruptures.

In a preferred embodiment of the invention the waveform is made as a substantially harmonic sine curve, an optimal mechanic friction being obtained between the outer layers and the adjacent intermediate layer/layers which are at the same time allowed to remain undeformed during the working process.

Further advantageous embodiments of the invention are described in the remaining dependent claims.

The invention furthermore relates to a method for the manufacture of a flashing rail with a skirt made from the roof flashing material as stated in claim 12.

The invention will now be further described by way of example in the following with reference to the schematic drawing, in which FIG. 1 shows a perspective view of a flashing material according to the invention, FIG. 2 a cross sectional view at a larger scale along the line II—II of the flashing material in a first embodiment of the invention, FIG. 3 a view corresponding to FIG. 2 of a second embodiment of the invention, FIG. 4 a skirt of the flashing material and a flashing rail, and FIG. 5 an illustration of the connection of the skirt with the flashing rail.

The deformable roof flashing material 1 shown in the drawing comprises a sandwich construction, which has been given a continuous waveform in a single direction.

The sandwich construction comprises two outer layers 2, 3 of metal foil, each having a thickness of 0.05 to 0.5 mm and consisting of a material suited for roof flashing purposes, for instance aluminium, zinc or copper which have or to which through surface treatment the desired properteries in respect of strength, deformability and weather resistance have been imparted. In the embodiment shown in FIG. 2, between the outer layers, a single resilient, non-adhesive intermediate layer 4 has been placed, said layer consisting in the embodiment shown of a rubber material, for instance EPDM rubber. However, said layer may be made from any suitable material having a flexibility and elasticity which allows it to be deformed together with the outer layers during the manufacture and during the mounting itself. The surfaces of the intermediate layer 4 correspondingly have to possess frictional properties which in the shown, not deformed delivery condition have the effect that the intermediate layer 4 and the outer layers 2, 3 are not displaced relative to each other, but on the other hand a certain mutual movement is allowed between the layers during the adaptation of the flashing material to the subjacent roofing. The desired frictional properties may be established through surface treatment of the resilient material. The thickness of the rubber layer lies in the range of 0.1 to 3.0 mm, preferably 0.5 to 1.5 mm.

Figure 3:
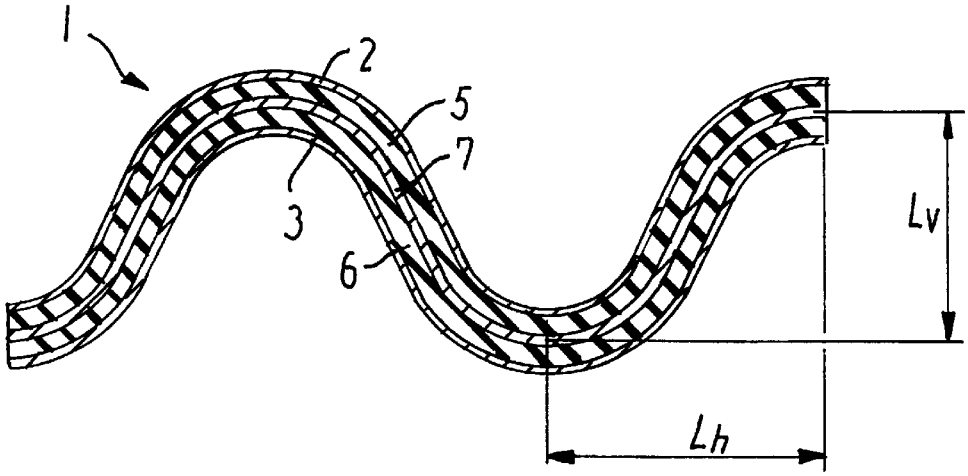

In the embodiment shown in FIG. 3 the sandwich construction is divided into five parts, whereas the structure described above is divided in three parts, an additional intermediate layer of metal foil 7 being interposed between the two outer layers 2, 3 and two intermediate layers 5, 6 adjacent to the outer layers and of resilient material. The thickness of the two resilient intermediate layers 5, 6 lies within the above range, whereas the thickness of the metal foil layer interposed varies depending on the desired weight and rigidity increase of the flashing material.

Figure 2:
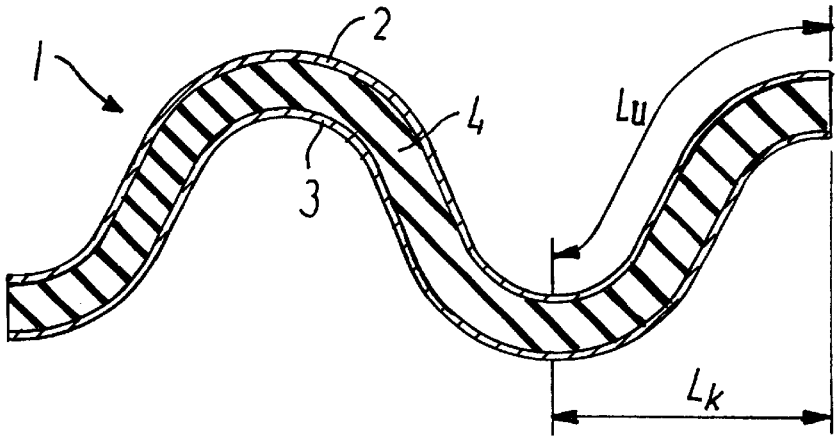

As will be most clearly seen from FIGS. 2 and 3 the waveform has been made as a substantially harmonic sine curve. The sine curve has a corrugation degree expressed as the ratio between the length Lk of a unit of the flashing material after corrugation and the length Lu of the corresponding unit in the starting position, which lies in the range of 0.4 to 0.8, preferably 0.55 to 0.75, and which in the embodiment shown is approx. 0.72. The wave length relative to the height of the waves is expressed by the ratio between the horizontal distance Lh from wave crest to wave valley and the vertical distance Lv from wave crest to wave valley and lies in the range of 0.8 to 1.2. By manufacturing the waveform with these parameters in the above intervals, an optimal combination of deformation and frictional properties is obtained, and at the same time the desired harmonic sine curve prevents the resilient intermediate layers from being exposed to elastic or plastic deformations during the manufacture, such that it/they is/are in a condition substantially free of stress and rests/rest passively between the outer layers in the undeformed delivery condition.

The material is manufactured by positioning of one or more intermediate layers between two separate metal foils, or between two halves of a single metal foil folded along a folding line, as besides mentioned and explained in Applicant's above-mentioned WO95/28536. Subsequently, the joined material is corrugated to the desired corrugation degree and to the desired ratio between wave length and wave height.

The flashing material can now for instance be coiled into a storage coil in view of subsequent cutting when used, or may be cut directly after the corrugation into finished pieces.

During the adaptation of the flashing material according to the invention to the structure of the individual roofing, the resilient layer/s will owing to the non-adhesive properties and the choice mentioned above of a material with suitable surface friction properties be able to follow the deformation of the remaining parts of the flashing material, which has the effect that the adaptation itself takes place without problems, and at the same time a lasting deformation with tight abutment is obtained between the flashing material and the subjacent roofing.

When mounted the flashing material has moreover the advantage that in case of ruptures or cracks in the material due to careless handling it will be self-sealing due to the fact that the resilient intermediate layer/s will close around such a rupture or crack.

Figure 4:
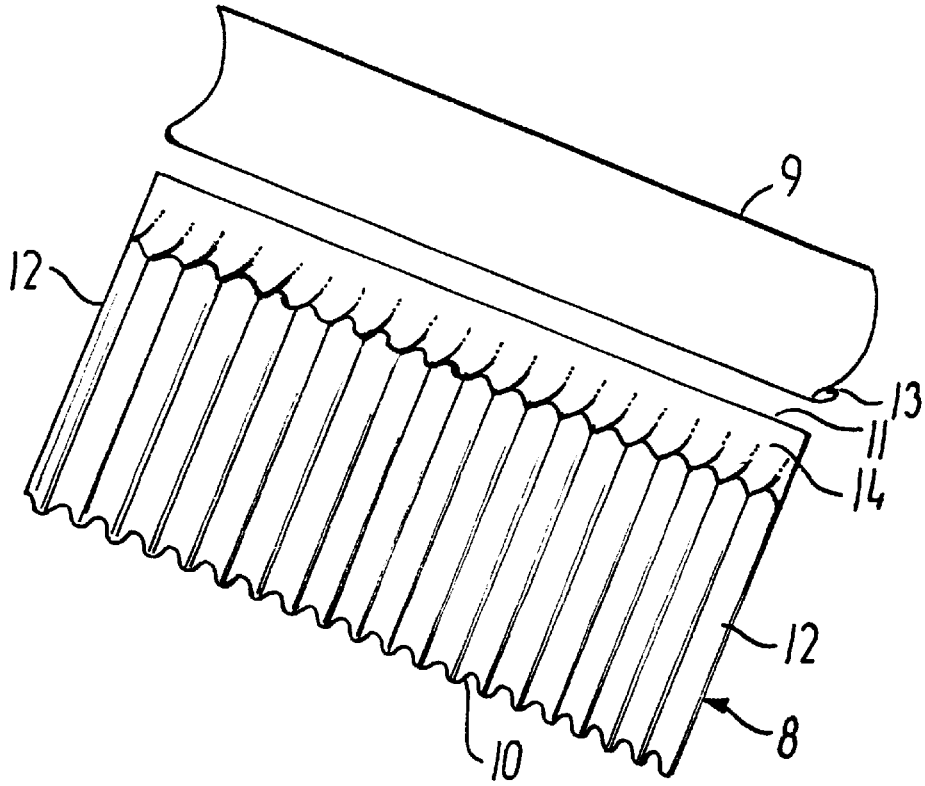

FIG. 4 shows a skirt 8 of the flashing material according to the invention and a flashing rail 9 with which the skirt is to be connected. FIG. 5 shows the skirt 8 and the flashing rail 9 from the end during assembly. The skirt 8 has a first side edge 10 which may be constituted of a folding in the outer layer 2, 3, if the outer layers are made from a single metal foil folded as mentioned above. Furthermore, the skirt 8 has two end edges 12, where at least the outer layers preferably are bent 180° to close the ends of the skirt. Finally, the skirt 8 has a second side edge 11, in which the corrugations have been laid down to provide a flat longitudinal flap 14, which locks the layers and facilitates a subsequent folding.

Figure 5:
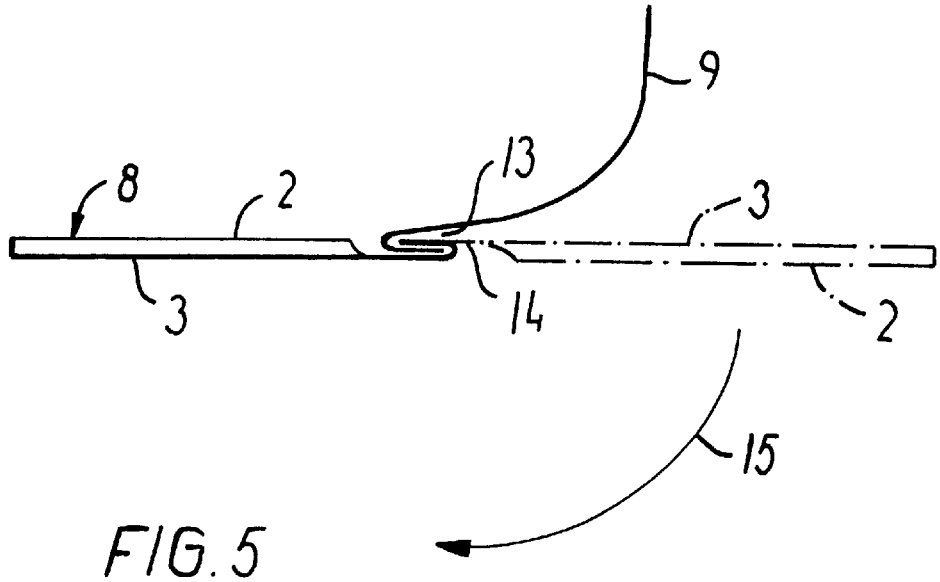

The flashing rail 9 is folded for the formation of a rabbet channel 13, in which the flat flap 14 is introduced as shown in FIG. 5 with a broken line, following which the skirt 10 is swung 180° as indicated by the arrow 15 to the position indicated by a fully drawn line. This rabbeting corresponds to what has been described in Applicant's DK-B-151 112 and corresponding EP-A-0 196 831, and as done according to these publications a resilient adhesive strip may be inserted in the joint.

According to the above an advantageous manufacturing method, in which the flashing material is manufactured with a view to forming part directly in a production of pre-manufactured flashing skirts connected with flashing rails, may comprise conveyance of a web-shaped metal foil, folding of the metal foil, insertion of a rubber cloth in the folded metal foil, corrugation of metal foil with rubber cloth, flattening of the not folded side edge of the folded metal foil for the formation of a flat flap, cutting of the metal foil web in predetermined lengths, folding of the end edges created by the cutting for the formation of a skirt with closed ends, introduction of the flat flap in a rabbet channel in a flashing rail, preferably together with a resilient, adhesive strip of for instance butyl rubber, and bending of the flattened flap for securing together the skirt and the flashing rail.

What is claimed is:

1. A deformable roof flashing material for use in connection with skylight windows and the like roof penetrating structures, said roof flashing material comprising a sandwich construction with two outer layers (2, 3) of metal foil and at least one intermediate layer (4; 5–7) positioned between the outer layers, said material having at least in one direction a continuous waveform, wherein at least the intermediate layer/s (4; 5, 6) adjacent to the outer layers is/are made from a non-adhesive resilient material having a flexibility and elasticity such that the intermediate layer/s is/are deformable with the outer layers during mounting, and in that said waveform is formed in such a manner that it maintains the mutual positioning between the outer layers and the adjacent intermediate layer/s by friction.

2. A roof flashing material according to claim 1, wherein said waveform is made as a substantially harmonic sine curve.

3. A roof flashing material according to claim 2, wherein the degree of corrugation expressed as the ratio between the length after corrugation (Lk) and the length in the starting condition (Lu) is in the range of 0.4 to 0.8.

4. A roof flashing material according to claim 2, wherein the ratio between the horizontal distance from wave crest to wave valley (Lh) and the vertical distance from wave crest to wave valley (Lv) is within the range of 0.8 to 1.2.

5. A roof flashing material according to claim 1, wherein the at least one intermediate layer (4) is a single resilient layer made from a rubber material.

6. A roof flashing material according to claim 5, wherein said rubber material consists of EPDM rubber.

7. A roof flashing material according to claim 5, wherein each resilient rubber layer (4; 5,6) has a thickness between 0.5 and 1.5 mm.

8. A roof flashing material according to claim 5, wherein each resilient rubber layer (4; 5, 6) has a thickness between 0.1 and 3.0 mm.

9. A roof flashing material according to claim 1, wherein the metal foil of the outer layers (2, 3) includes at least one of aluminum, zinc and copper.

10. A roof flashing material according to claim 9, wherein each outer layer (2, 3) has a thickness between 0.05 and 0.5 mm.

11. A roof flashing according to claim 9, wherein the outer layers (2, 3) consist of parts of one and the same piece of material which is folded along a folding line.

12. A roof flashing material according to claim 1, wherein the at least one intermediate layer includes two resilient intermediate layers (5, 6) of rubber and a metal foil layer (7) interposed between these layers.

13. A roof flashing material according to claim 1, wherein the degree of corrugation expressed as a ration between the length after corrugation (Lk) and the length in the starting condition (Lu) is in the range of 0.55 to 0.75.

14. A method for the manufacture of a flashing rail with a skirt made from roof flashing material comprising a sandwich construction with two outer layers of metal foil and at least one intermediate non-adhesive layer positioned between the outer layers, said material having at least in one direction a continuous waveform, wherein at least the intermediate layer/s adjacent to the outer layers is made from a resilient material having a flexibility and elasticity such that the intermediate layer/s is/are deformable with the outer layers during mounting, and in that said waveform is formed in such a manner that it maintains the mutual positioning between the outer layers and the adjacent intermediate layer/s by friction, comprising:

conveying a web-shaped metal foil;

folding the metal foil;

inserting a rubber cloth in the folded metal foil;

corrugating the metal foil with rubber cloth;

flattening the unfolded side edge of the folded metal foil to form a flat flap;

cutting the metal foil web in predetermine lengths;

folding the end edges created by the cutting to form a skirt with closed ends;

introducing the flat flap into a rabbet channel in a flashing rail; and bending the flattened flap to secure together the skirt and the flashing rail.

15. The method of claim 14, wherein the flat flap is introduced into the rabbet channel in a flashing rail together with a resilient, adhesive strip.

16. The method of claim 15, wherein the resilient adhesive strip is made of butyl rubber.

* * * * *